US012747545B2

(12) United States Patent
Boere et al.

(10) Patent No.: US 12,747,545 B2
(45) Date of Patent: Sep. 29, 2026

(54) METHOD FOR MAKING A GRATED TRENCH CHANNEL

(71) Applicant: J K WILLIAMS CONTRACTING PTY LTD, Penrith (AU)

(72) Inventors: Marc Boere, Penrith (AU); Glenn Hartog, Penrith (AU); Tim Lyle, Penrith (AU); Steve Sinclair, Penrith (AU); Lance Bennett, Penrith (AU)

(73) Assignee: J K WILLIAMS CONTRACTING PTY LTD (AU)

( * ) Notice: Subject to any disclaimer, the term of this patent is extended or adjusted under 35 U.S.C. 154(b) by 950 days.

(21) Appl. No.: 18/003,103

(22) PCT Filed: Jun. 23, 2021

(86) PCT No.: PCT/AU2021/050656
§ 371 (c)(1),
(2) Date: May 11, 2023

(87) PCT Pub. No.: WO2021/258144
PCT Pub. Date: Dec. 30, 2021

(65) Prior Publication Data

US 2024/0011228 A1 Jan. 11, 2024

(30) Foreign Application Priority Data

Jun. 23, 2020 (AU) ..... 2020902078

(51) Int. Cl.
*E01C 19/48* (2006.01)
*E01C 11/22* (2006.01)

(52) U.S. Cl.
CPC ..... *E01C 19/4893* (2013.01); *E01C 11/223* (2013.01); *E01C 11/227* (2013.01); *E01C 2201/205* (2013.01)

(58) Field of Classification Search
CPC . E03F 5/0401; E03F 5/04; E03F 5/046; E03F 3/046; E01C 19/4893;
(Continued)

(56) References Cited

U.S. PATENT DOCUMENTS 3,749,504 A * 7/1973 Smith ..... E01C 19/008 404/84.2
3,792,133 A * 2/1974 Goughnour ..... E01C 19/4893 264/40.5
(Continued)

FOREIGN PATENT DOCUMENTS

DE 29802459 4/1998
EP 1857592 11/2007
(Continued)

OTHER PUBLICATIONS

International Preliminary Report on Patentability, report issued on Dec. 13, 2022, International Application No. PCT/AU2021/050656, International Filing Date Jun. 23, 2021.
(Continued)

*Primary Examiner* — Abigail A Risic
(74) *Attorney, Agent, or Firm* — Summit Patents, PC

(57) ABSTRACT

Systems and methods are described for forming a concrete trench drain channel using a slipform paving machine. The drain channel has frames that define an upper opening that can receive a grate. The slipform methods provide the slipform paving machine with moulds shaped to represent the external and internal profiles of the drain channel. One or more frames are installed in an abutting manner on a trestle that extends from the slipform paving machine so the frames are located at the upper opening of the inner profile of the drain channel in the internal mould. The slipform paving machine is actuated to continuously slipform the channel in concrete in between the exterior and interior moulds and around the frames. This process is repeated until
(Continued)

the frames are at least partially embedded in the concrete and located across the opening of the drain channel.

6 Claims, 10 Drawing Sheets

(58) Field of Classification Search
CPC .... E01C 19/4886; E01C 19/48; E01C 11/223; E01C 11/227; E01C 11/22; E01C 2201/205
See application file for complete search history.

(56) References Cited

U.S. PATENT DOCUMENTS 3,877,855 A * 4/1975 Hanson ..... E21D 11/102 425/64
3,959,977 A * 6/1976 Godbersen ..... E02F 5/101 425/63
4,319,859 A * 3/1982 Wise ..... E02B 5/02 404/96
5,653,553 A * 8/1997 Gunter ..... E02B 5/00 405/36
7,967,523 B2 * 6/2011 Hetzler ..... E03F 3/046 405/118
8,920,070 B2 * 12/2014 Zimmermann ..... E01C 19/4886 404/98
2009/0097921 A1 * 4/2009 Hetzler ..... E03F 3/046 405/119
2010/0008718 A1 * 1/2010 Cooper ..... E01C 19/4886 404/2
2015/0322633 A1 * 11/2015 Scattergood ..... E01C 19/008 404/2
2018/0274239 A1 * 9/2018 Cullen ..... E04D 13/076

FOREIGN PATENT DOCUMENTS

FR 2400084 3/1979
FR 2843760 7/2006
JP S50155062 12/1975

OTHER PUBLICATIONS

International Search Report & Written Opinion mailed Aug. 30, 2021, International Application No. PCT/AU2021/050656, International Filing Date Jun. 23, 2021.
Multidrain Systems Inc, Steel Trench Drain Forming System [retrieved from internet on Aug. 18, 2021, https://trenchdrain.com/wp-content/uploads/2019/02/Multidrain-steel-trench-Brochure.pdf.

* cited by examiner

METHOD FOR MAKING A GRATED TRENCH CHANNEL

TECHNICAL FIELD

The invention relates to the field of concrete roadway construction. In particular, the invention relates to an improved method for forming a concrete roadside gutter channel and equipment for carrying out said method.

BACKGROUND OF THE INVENTION

Modern roadway construction often required the formation of concrete carriageways that are serviced by gutters or water channels that run along-side the carriageway and provide a way for runoff rainwater to be efficiently removed from the roadway surface.

Typically, these have relatively deep and wide channels that are required to handle the runoff water from a multi-lane roadway during e.g. wet weather. The channels are usually protected somewhat from blockage via the placement of a grate over the channel so that larger debris cannot enter the channel and cause a blockage to water flow. The grating also enables vehicles to drive over the channel if the road design requires.

The conventional way of forming such channels is to create a temporary fixed mould for the outer dimensions of the channel in situ and pouring concrete into the mould. This requires a formwork mould to be constructed covering the entire length of the required channel, which is removed after curing the concrete. This is a painstaking process requiring considerable time and skill.

It is also common to use a preformed insert to provide an inner lining of the channel. Such inserts allow consistent dimensions of the channel for supporting a grate. For example, such preformed inserts are provided by ACO Infrastructure Pty Ltd under such names as 'ACO Klassikdrain K300'. These are useful but add an extra level of complexity and expense to the channel-forming process. They also tend to be heavy and very time consuming to install and add another item on site that requires storage and handling.

Overall, the prior art represents very manual and exacting processes for forming road channel drains that are time-consuming, physically exacting and therefore expensive on a cost per distance basis.

Accordingly, it is an object of the invention to provide a way of forming a roadside drainage channel that eliminates at least some of the problems associated with the prior art.

SUMMARY OF THE INVENTION

The invention may broadly be defined as a method of continuously forming a concrete trench drain using a concrete slip forming machine, with a modified mould that produces the desired profile of the channel. Further, the invention includes the continuous placing of frames that define the upper mouth of the channel and the slipforming of the channel around these frames.

According to a first broad aspect of the invention, there is provided a method for slipforming a concrete trench drain channel using a slipform paving machine, said drain channel having frames defining an upper opening of said channel and adapted to receive a grate; said method including the steps of: providing said paver with moulds shaped to represent the external and internal profiles of said channel; installing one or more of said frames in an abutting manner on a trestle extending from said paver in the desired location for said channel such that said frames are located at the top of the inner profile of said channel in said internal profile mould; actuating the paver to continuously slipform the channel in concrete in between said exterior and interior moulds and around said frames; and repeating the above steps to form the entire trench drain channel.

Such a process can be performed by a conventional slipforming unit, with modification to the mould to produce the channel profile and with further modification to provide a locating device for the frames.

Using the slipforming process to continuously create the channel structure greatly increases the speed of the overall process. This therefore reduces the cost of the channel per unit length and helps provide a consistent profile throughout the channel without the precise and time-consuming work of onsite mould construction and without the added cost of the preformed insert itself.

The process according to the invention also helps to eliminate horizontal construction joints that inevitably become cold joints that are produced using fixed form boards, as the concrete is poured in one unit including the kerb.

For the process according to the invention, the pour runs tend to be anywhere from 50-120 m per day so any vertical cold joints are spaced out significantly wider than in conventional techniques.

Traditionally, the form and pour method will not include a kerb pour: a paver will usually come in afterwards and pour the kerb on the formed and poured channel. In the present invention, the roadway and kerb pour can be completed in one action.

The inventive process has the added advantage of being able to create the entire drain channel as a monolithic concrete structure and the vibration associated with the slipforming method also tends to provide well-compacted concrete.

Compared with basic slipforming of the channel, the present invention and its inclusion of the frames and allowing the concrete to be slip-formed around the frames allows the achievement of the desired dimensional stability for the placement of the grate that would not be achievable via the slipforming process alone.

Preferably said frames are provided in lengths of between 1.5 metres and 2.5 metres long and are connected to one another by an adjustable fastener such as a turnbuckle. This allows the frames to be maintained in a consistent position relative to each abutting frame during the slipforming process. The adjustable nature of e.g. a turnbuckle allows sufficient angular differentiation between each abutting frame to accommodate roadway curvature.

Preferably, the ends of the frame are provided with one or more levelling lugs located at the abutting ends of said frames that are adapted to contact the underside of the abutting frame to assist in maintaining a consistent level of said frames during slipforming. These allow the abutting frames to maintain correct levelling with respect to one another during the slipforming process.

Preferably, said frames have a parallel outrigger reinforcing bar extending from at least one side of said frame that is adapted to embed into the concrete and anchor said frame in place after he concrete has cured.

According to another aspect of the invention, there is provided a concrete trench drain channel formed in situ by a process of continuous slipforming.

According to another aspect of the invention, there is provided a concrete slipforming mould adapted to facilitate the continuous slipforming of a trench drain channel.

According to another aspect of the invention, there is provided a frame for defining the upper opening of a trench drain channel, whereon said frame is adapted for the continuous concrete slipforming of said trench drain channel.

Preferably, said frames are provided in lengths of between 1.5 metres and 2.5 metres long and are connected to one another by an adjustable fastener such as a turnbuckle. More preferably, the ends of the frame are provided with one or more levelling lugs located at the abutting ends of said frames that contact the underside of the abutting frame to assist in levelling of said frames during slipforming.

Preferably, said frames have a parallel outrigger bar extending from at least one side of said frame that is adapted to embed into the concrete and anchor said frame in place after he concrete has cured.

According to another aspect of the invention, there is provided method for forming a concrete trench drain channel, said method including the step of continuously slipforming the trench drain channel in situ.

Now will be described, by way of a specific, non-limiting example, a preferred embodiment of the invention with reference to the drawings.

DETAILED DESCRIPTION OF THE INVENTION

The invention may broadly be defined as a method of continuously forming a concrete trench drain using a modified concrete slip forming machine, with a modified mould that produces the desired profile of the channel and concurrently lays frames that define the upper mouth of the channel, and slipforms the channel around these frames. These frames then provide a dimensionally consistent point of support for the grates that are to cover the channel to prevent blockage by debris.

Slipforming is a well-known process for creating roadways and associated structures. It is essentially the process of pouring concrete into a continuously moving mould form. It allows the creation of continuous, non-interrupted cast-in-place concrete structures without joints.

In horizontal slip-forming of roadways, and associated structures such as barriers, the concrete is laid down, vibrated, worked, and settled in place while the form itself slowly moves ahead. The basic technique of slipforming has been used since at least the 1950's for roadways and barriers.

However, prior to the present invention, this technique has not been used successfully for the continuous creation of grated trench channels. Grated trench channels are required to have sufficient structure and dimensional consistency to support pre-formed and removable grates at the top of the channel. Typical trench grates for this purpose are those supplied by NEPEAN Building & Infrastructure Pty Ltd, under the WELDLOK name, and are required to meet predetermined standards, such as Australian Standard AS3996-2019.

Standard slip forming of a trench channel has not been common practice, as the slipforming process alone does not provide a sufficiently consistent support structure for the trench grate. The dimensional stability of the concrete exiting the slipforming mould also has not hitherto been sufficient to allow trench construction by slipforming alone.

The inventive process incorporates the continuous slipforming of concrete around a frame designed to span the upper opening of the trench and provides a dimensionally stable support for the grate.

Figure 1:
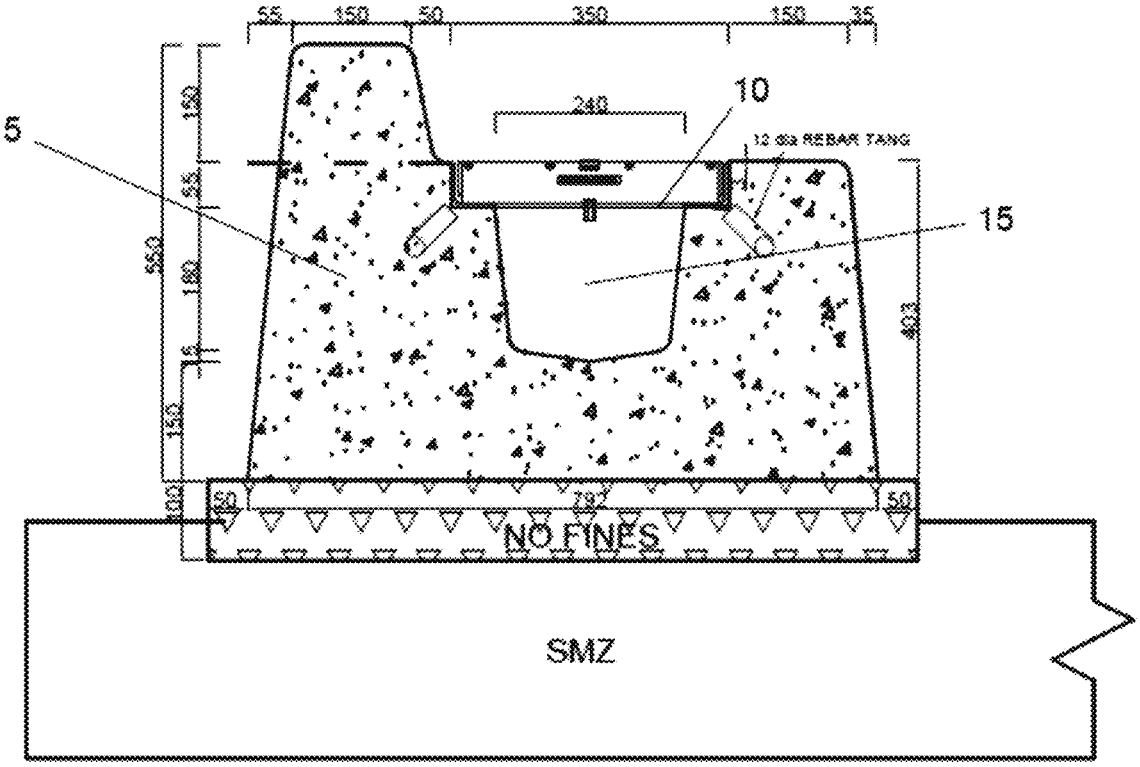
FIG. 1 is a cross section of a concrete trench drain of a type that may be formed by a method according to the invention.

Turning to FIG. 1, there is shown a cross-sectional diagram of a slip-formed concrete trench 5, defining a water-carrying opening 15 formed according to the inventive process. The frame 10 is located across said opening 15 and is sized to receive a standard trench grate (not shown).

The frame 10 has reinforcing bars 20 that run parallel to the frame 10 and which are angled downward into the concrete, in this embodiment. These provide an anchor for the frame in the concrete.

Figure 2:
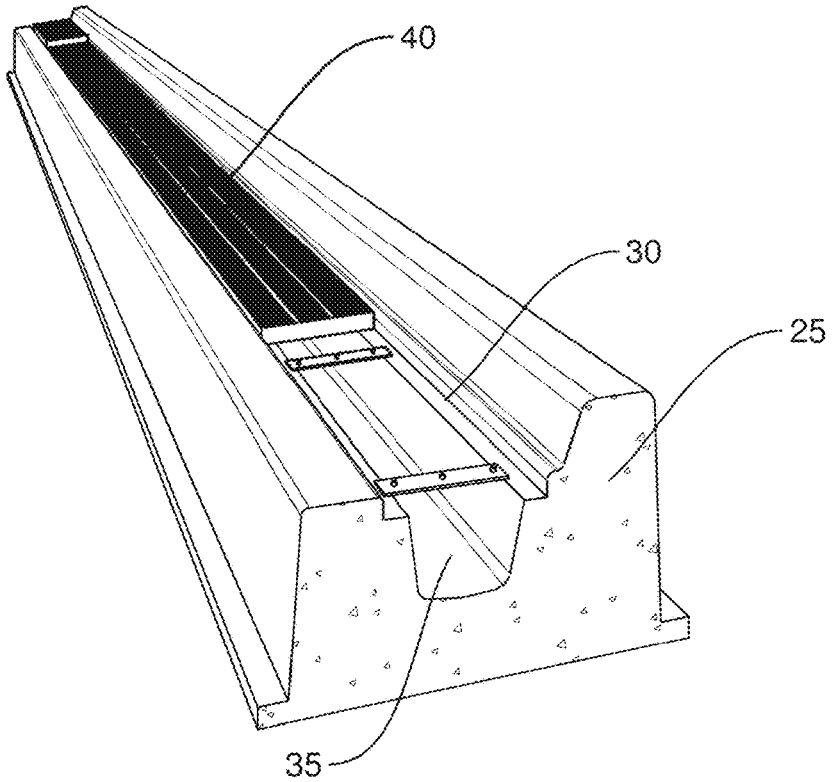
FIG. 2 is a photograph of a grated concrete trench drain formed by a method according to the invention.

Turning to FIG. 2, there is shown a section of a concrete trench drain 25 formed according to the invention. The location of the frame 30 atop the trench opening 35 can be seen, and the frame is also shown holding several trench grates 40.

Figure 3:
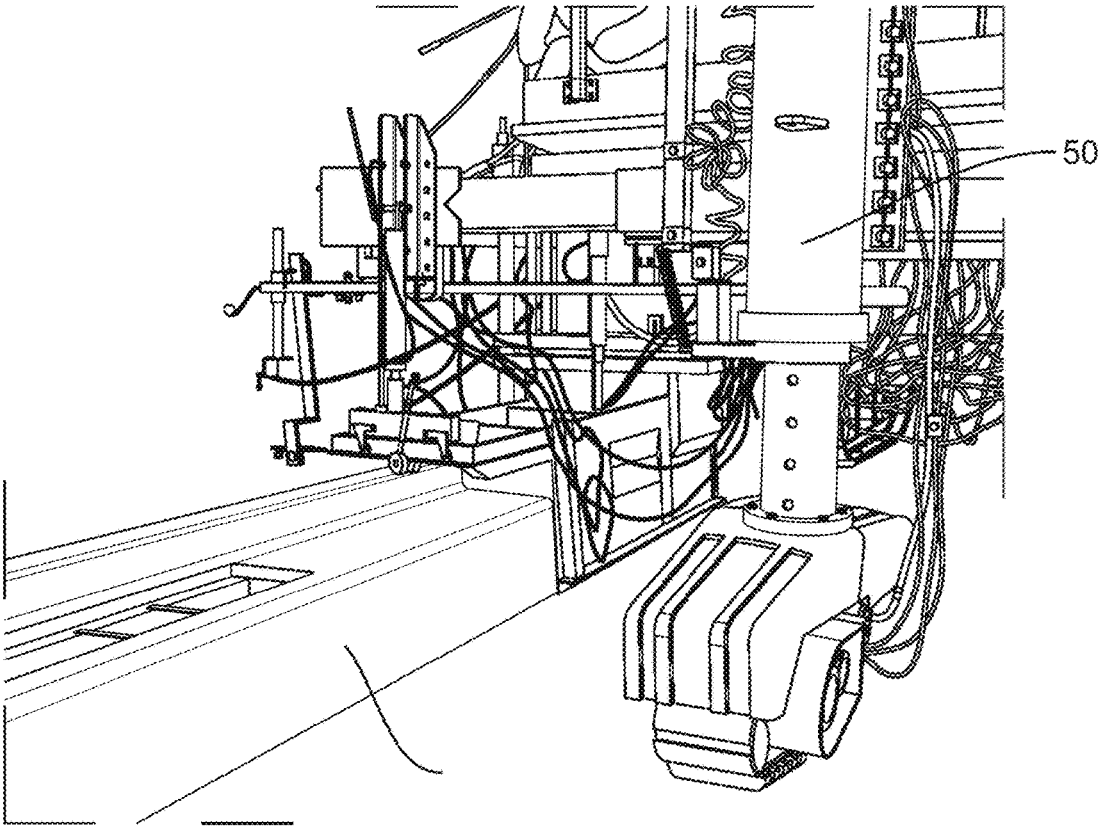
FIG. 3 is a photograph of the trench drain of FIG. 2 being formed by a slipformer.
Figure 4:
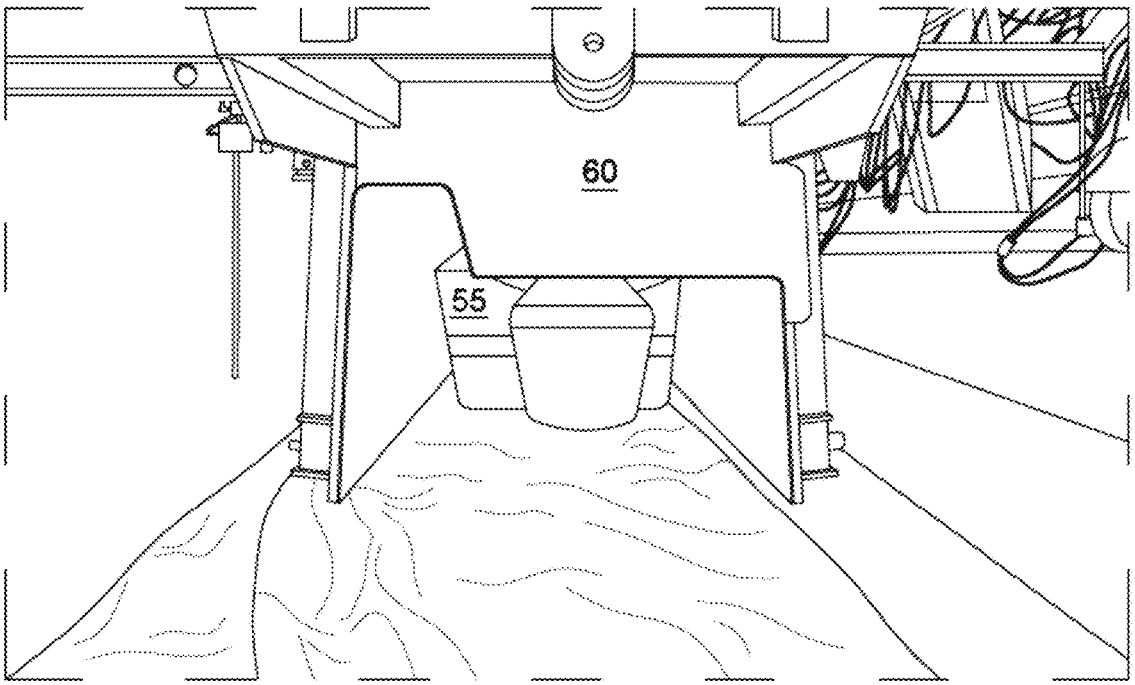
FIG. 4 is a photograph of the rear end of a mould attached to a slipformer that is adapted to produce a channel according to the invention.

FIG. 3 shows the process of forming the concrete trench channel 45 using a modified slip-forming machine. In this example, the slipforming paving machine 50 is a Commander III Slipform Paver supplied by GOMACO Corporation. FIG. 4 shows the mould profile 55 installed on the paver 60 to produce the trench channel.

Figure 5:
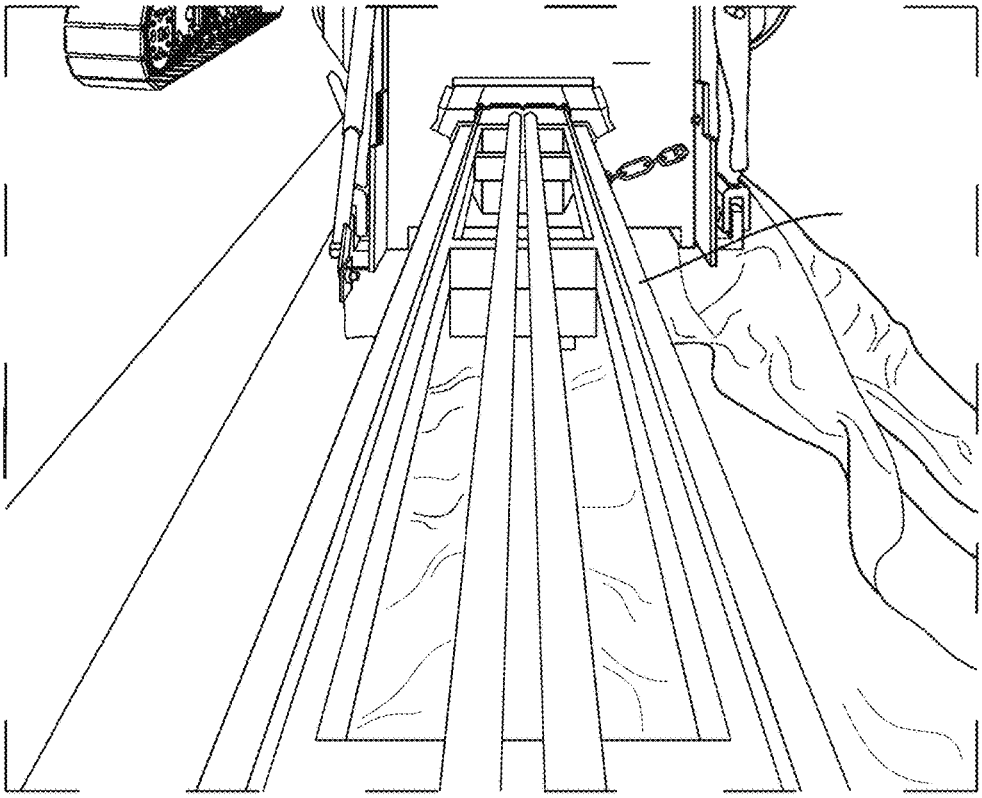
FIG. 5 is a photograph of a front end of a slipformer mould showing a trestle for supporting a frame according to the invention.
Figure 12:
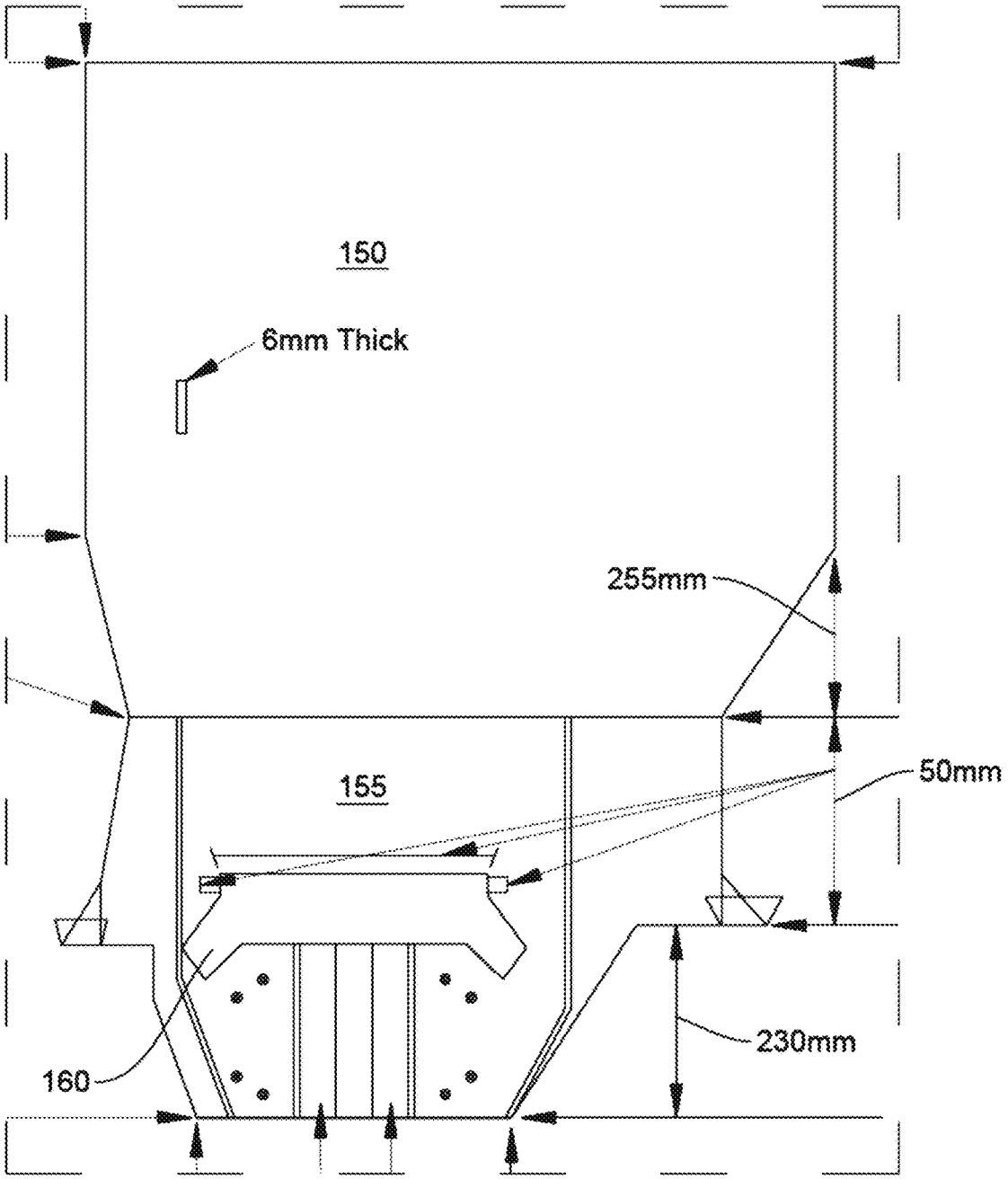
FIG. 12 is a diagram of a front view of a paver hopper adapted for use with the invention.

Extending out of the reverse side of the paver 60, as shown in FIG. 5, can be seen a trestle 65 that is used to hold and locate the frames (not shown) during the process. As the paver 60 advances, the concrete trench is formed around the frames that are laid on top of the trestle 65. During the process, more frames are laid on the trestle to be 'consumed' by the slip forming process as it advances, as shown in FIG. 12.

Figure 6A:
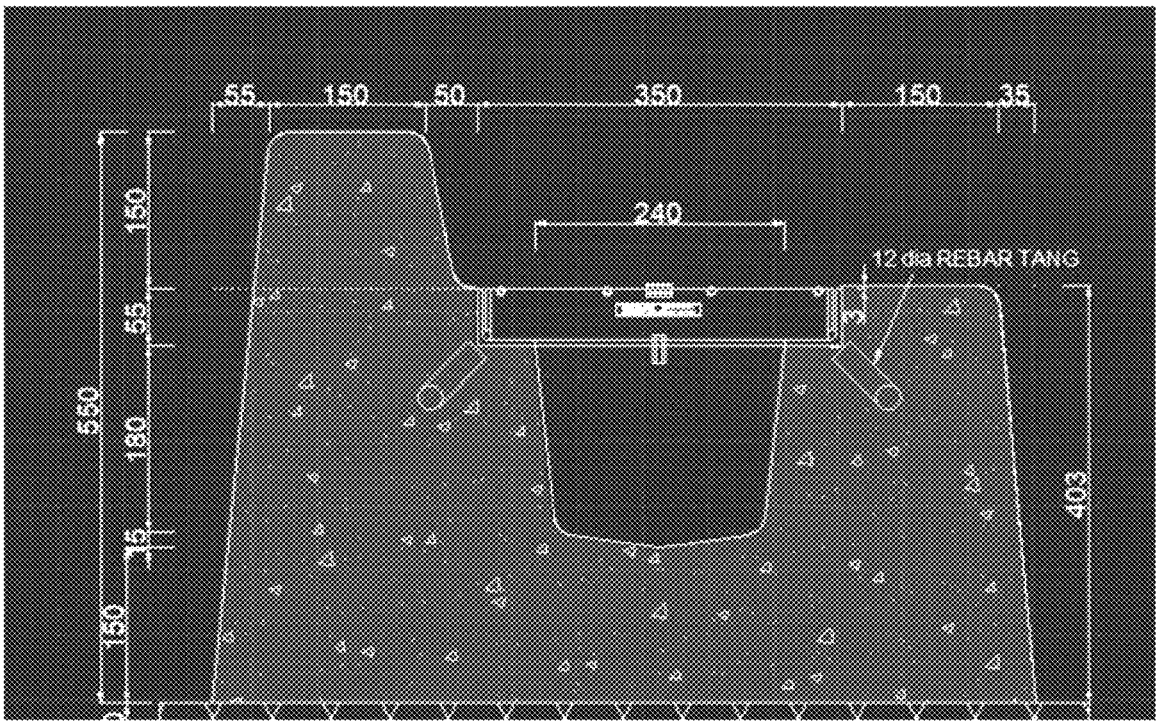
FIGS. 6*a*, 6*b* and 6*c* are diagrams of alternative trench drain profiles that may be formed by a process according to the invention.
Figure 6B:
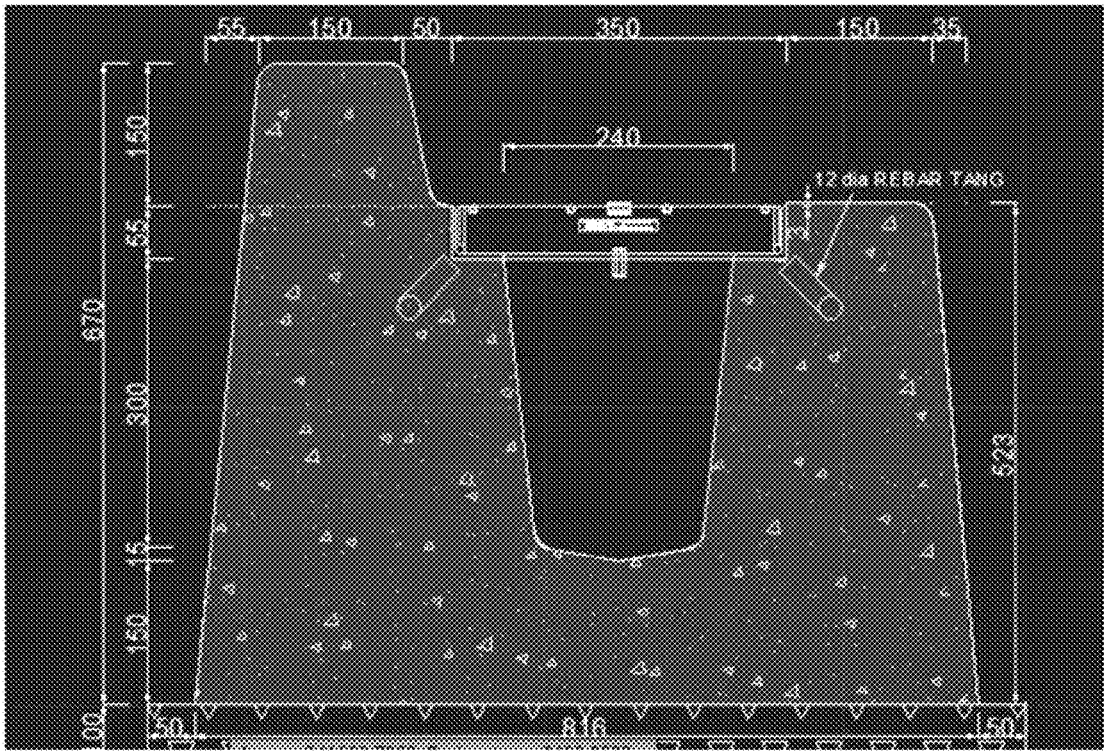
Figure 6C:
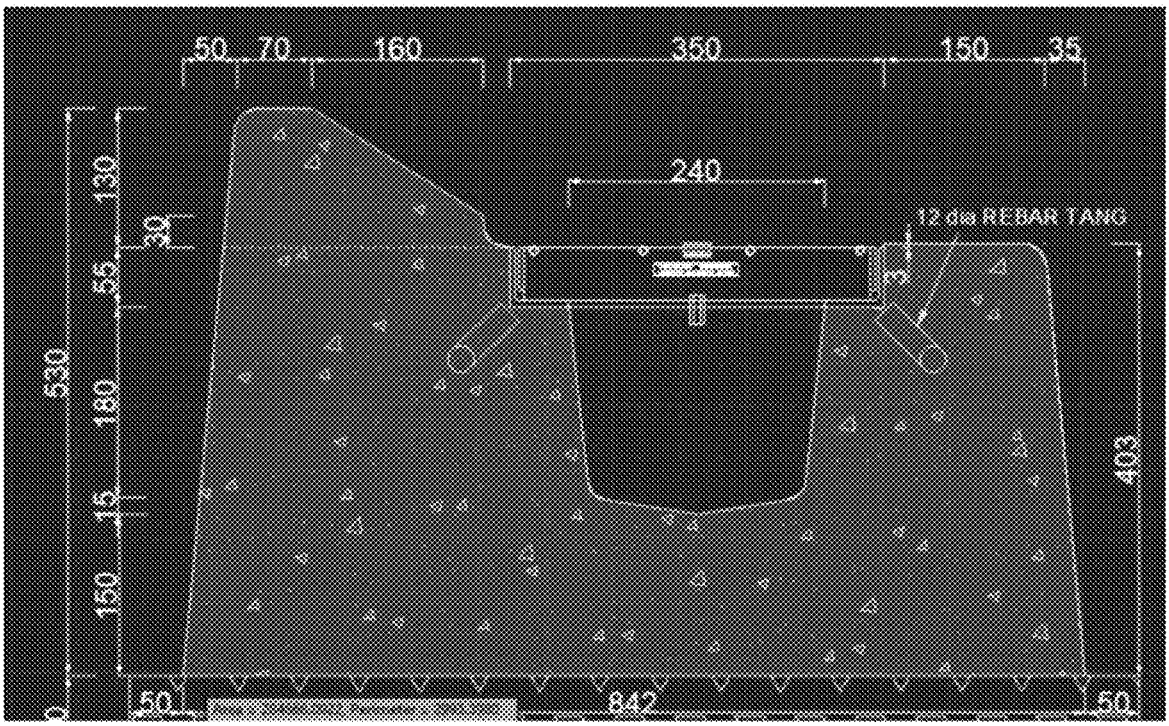

FIGS. 6*a*, 6*b* and 6*c* show variations in the profile of the slip-formed trench channel that can be produced by this process with commensurate alteration of the mould.

Figure 7:
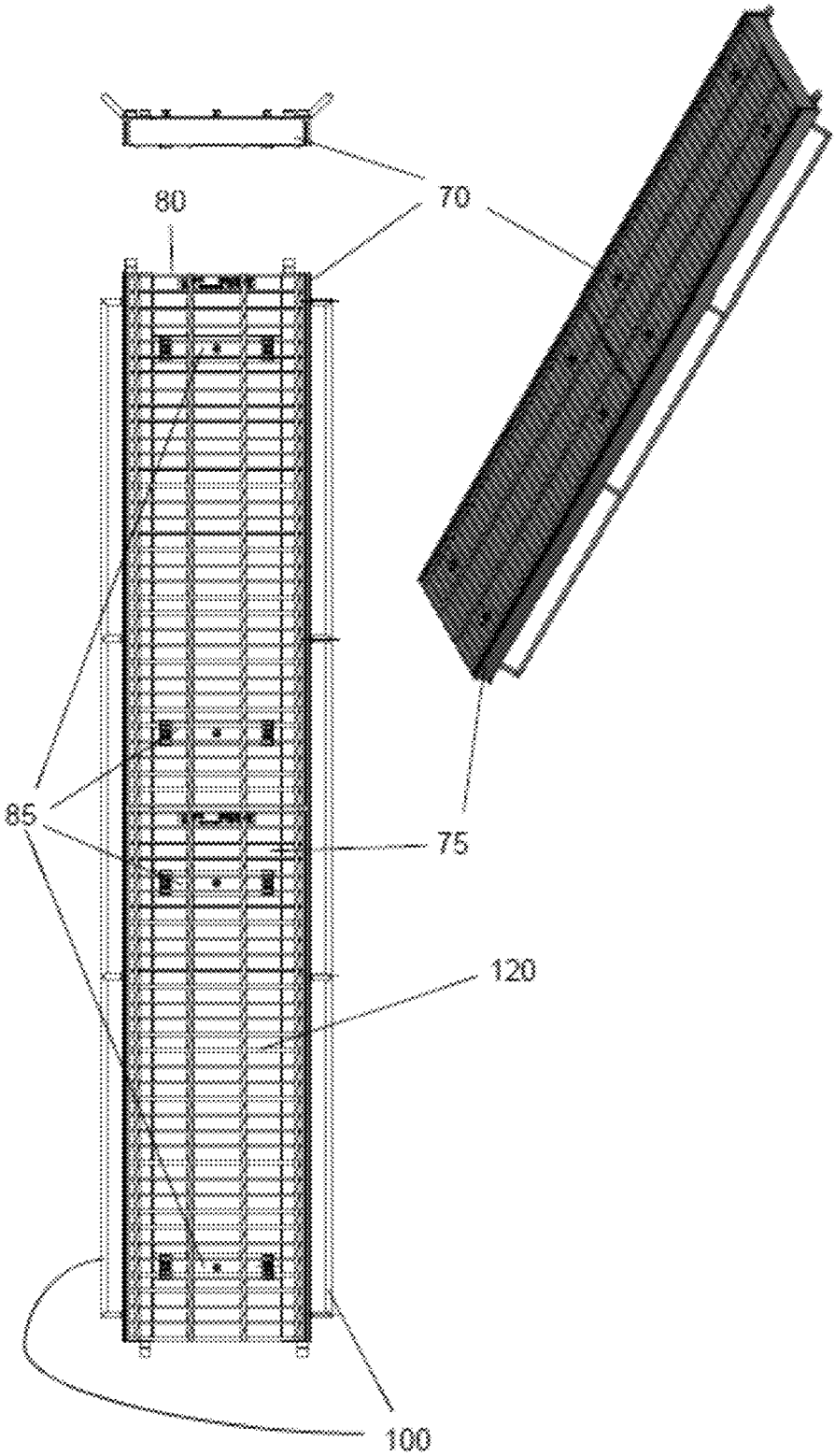
FIG. 7 is a set of diagrams of top, side and perspective views of a frame according to the invention.

FIG. 7 shows the frame in greater detail. In this example, the frame 70 is approximately 2000 mm long and 350 mm wide. It is made of galvanised steel L-shaped members along the sides 75 and ends 80 and is reinforced by four steel cross-bands 85.

Figure 8:
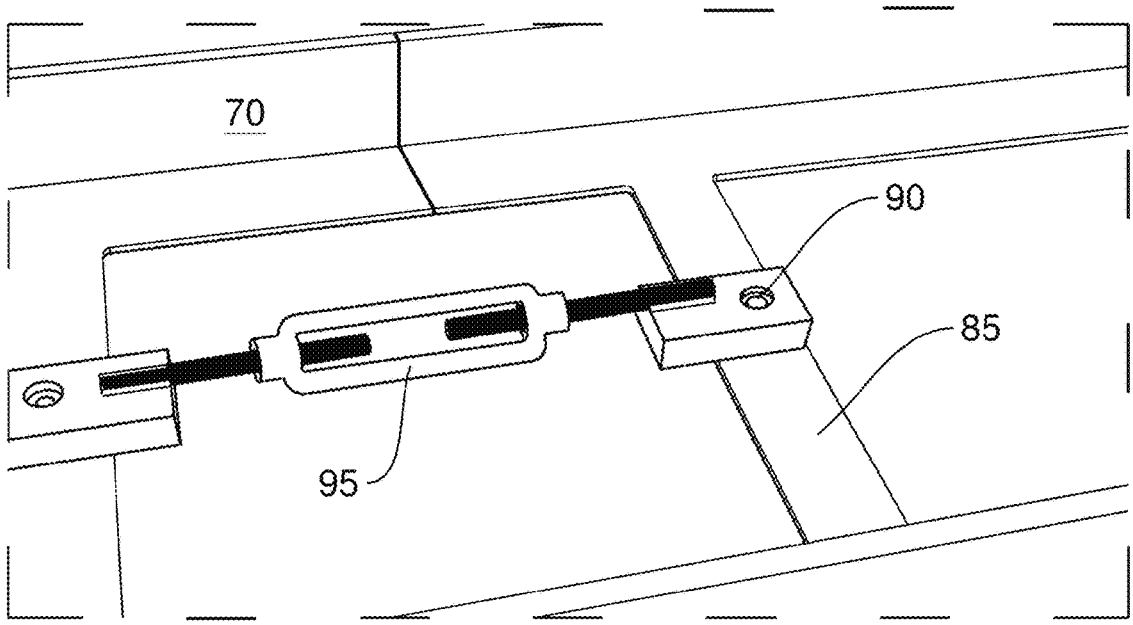
FIG. 8 is a photograph of two frames according to the invention joined by a turnbuckle in preparation for the slipforming process.

On the cross-bands are mounted ferrules 90 that allow abutting frames to be connected via adjustable fasteners, such as turnbuckles 95 as shown in FIG. 8. These connections provide stability between abutting frames during the slipforming process, which can otherwise tend to cause movement of the frames as they pass through the paver, due to the highest levels of vibration typically experienced in the paver hopper.

As shown, the turnbuckles 95 fit over the ferrules 90 for easy removal. Turnbuckles also accommodate any dimensional gaps between the frames since frames are typically not manufactured with close tolerances.

The turnbuckles also allow sufficient movement to accommodate any lateral curvature required by the channel in order to follow the line of the roadway.

Figure 9:
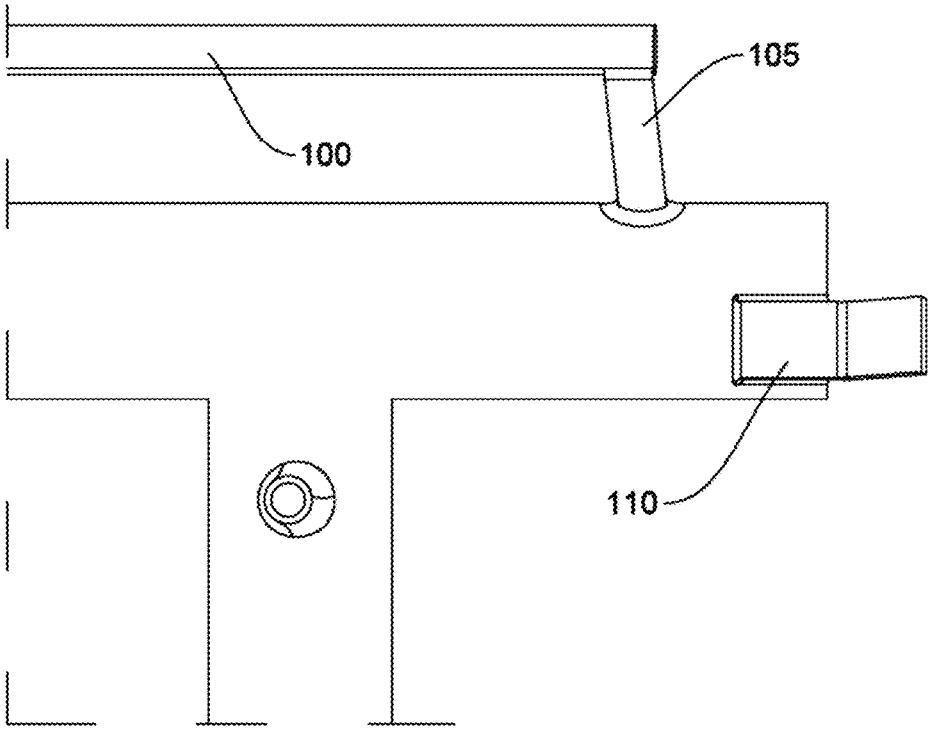
FIG. 9 is a photograph of detail of the frame according to the invention showing the levelling lugs and the outrigger bar.

Outside the side members are attached reinforcing bars 100 made from 12 mm diameter steel bars attached via tangs 105, as illustrated in FIGS. 7 and 9. The reinforcing bars 100 extend outwards and downwards from the frame 70 to provide an anchor for the frame in the concrete.

Also illustrated in FIG. 9 are the levelling lugs 110 that are welded to the ends of the frame 70. These extend outward toward, and in contact with, an abutting frame 115. They assist in preventing vertical movement or twisting of the frames relative to one another during the slipforming process.

FIG. 7 also illustrates the positioning of the trench grate 120 on the frame of FIG. 7.

Figure 10:
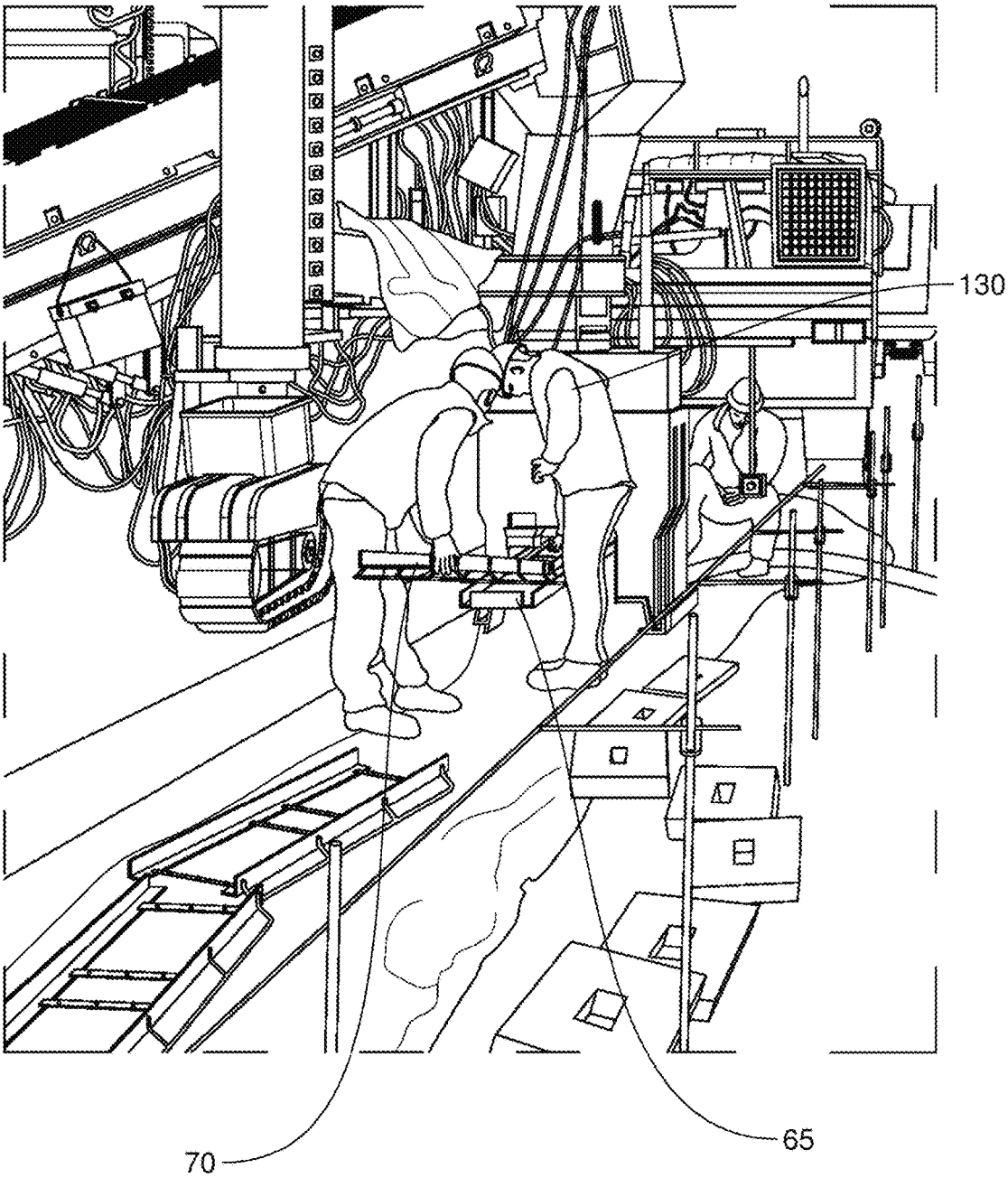
FIG. 10 is a photograph of the loading of the frames onto the trestle according to the invention.

During the process, in order for the frames to be encapsulated by concrete, the frames 70 are placed on a trestle 65 two at a time. Two construction workers 130 are positioned to lift and connect the frames using the turn buckles, as shown in FIG. 10.

Figure 11:
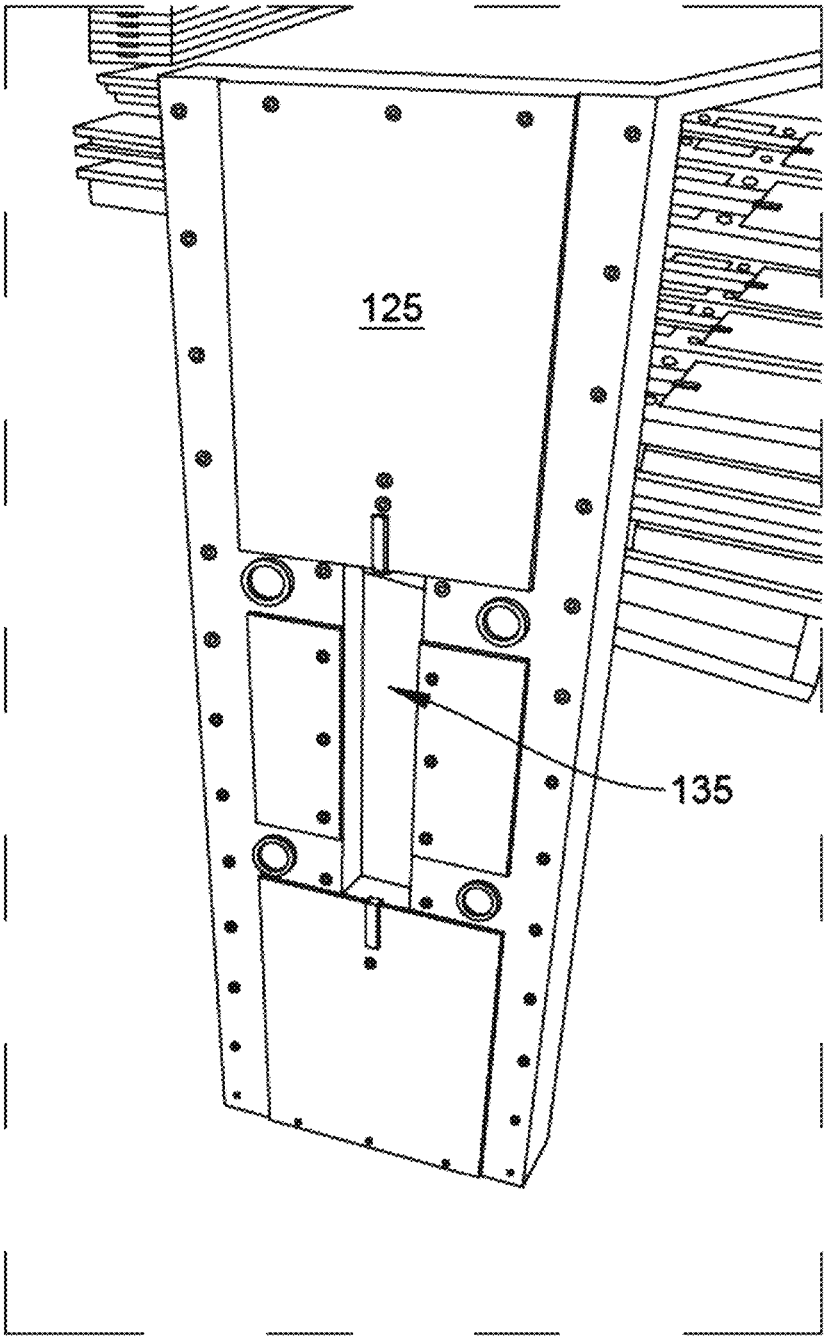
FIG. 11 is a photograph of the panels that are used to cover the trench mouth during slip-forming.

To stop the frames from shifting laterally in relationship to each other, and to stop concrete pouring into the channel, drop-in panels 125, as shown in FIG. 11, were developed specifically to suit size of the frames and accommodate for frame penetrations and extrusions i.e. nut inserts and turnbuckles.

The panels 125 are illustrated in FIG. 11 and are made from a QUICKSILVER® lining material, countersunk screwed to purpose-built frames to sit tightly in the trench frames 70, preventing any movement of the panels. The panels are placed inside the frames and prevent the concrete from passing through the frames into the space where the channel is formed. The slot 135 in the centre of the panel 125 allows access to the turnbuckles that tie the successive frames to one another.

Depending on the set-up of the slipforming operation, it may be necessary to tie the first frame in the process to a fixed anchor, e.g. to the tow-ball of a truck or a large concrete block, using an approximately 5 tonne sling or chain attached to the anchor. This holds the first frame in position preventing it from laterally moving along with the paver, as the excessive force/vibration experienced during slip forming may tend to drag the frame with it.

For efficiency, the frames and panels are lined up in front of the paver. Once the paver has formed several frames, the panels are removed, pressure-cleaned and reused. This means e.g. only fifteen panels are required during the whole process no matter the drainage run length.

The invention as described above represents a new and advantageous method of forming a concrete trench channel. To compare this method with the existing 'form and pour' method, table 1 sets out the main advantages of the inventive process in speed, quality, and cost:

TABLE 1

| | Slip Form Method | Form and Pour Method |
|---|---|---|
| Cost | \$350-\$400/m | \$550-\$625/m |
| Speed | 100-120 m/day | 20-40 m/day |
| Quality | Monolithic structure with very well compacted concrete vibrated by the paver. | Hand placed (limited vibration) concrete with up to 3 cold joints. |
| Components | Concrete, frame & grate. | Concrete, frame & grate, preformed channel. |

The concrete mix design is a slightly modified version of the standard slip form mix that is used for jersey barrier construction. However, to reduce any slump on the side walls of the channel we have an inclusion of synthetic fibres (e.g. polypropylene fibres 150, rate of 1×0.9 KG bag/$m^3$ concrete), to enable correction of the internal side walls of the channel during the pour. Nominal strength 25 Mpa at a 40 mm slump.

Figure 13:
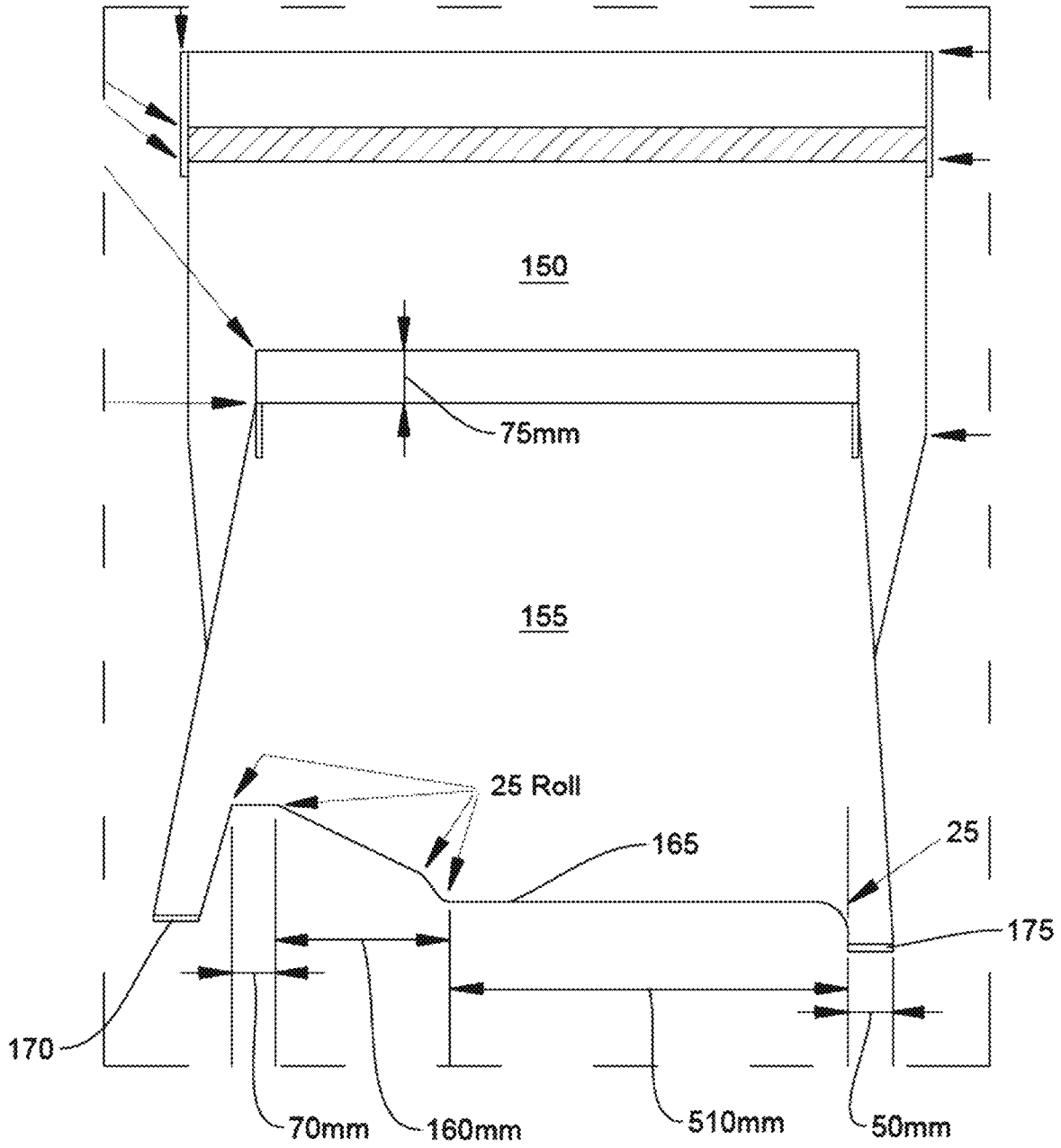
FIG. 13 is a diagram of a rear view of a paver hopper adapted for use with the invention.

FIGS. 12 and 13 show front and rear views of a paver hopper 150 adapted for use with the present invention. In FIG. 12, the concrete hopper 150 sits above the mould 155. There is an opening 160 in the mould that allows the frames (not shown) to enter the mould atop a trestle (not shown). The position of the trestle 65 can be seen in FIG. 5.

In FIG. 13, the upper face of 165 of the mould represents the upper shape of the trench drain as it is cast via the slipforming process. The mould 165 may be augmented with lower side skirts (not shown) extending from the sides of the mould (170, 175) to provide a trench drain casting of varying heights relative to the ground. This can also be seen in FIG. 4.

It will be appreciated by those skilled in the art that the above-described embodiment is merely one example of how the inventive concept can be implemented. It will be understood that other embodiments may be conceived that, while differing in their detail, nevertheless fall within the same inventive concept and represent the same invention.

The invention claimed is:

1. A method for slipforming a concrete trench drain channel using a slipform paving machine, said concrete trench drain channel having frames defining an upper opening of said channel and adapted to receive a grate; said method including the steps of:

providing said slipform paving machine with moulds shaped to represent the external and internal profiles of said concrete trench drain channel;

installing one or more of said frames in an abutting manner on a trestle extending from said slipform paving machine in the desired location for said concrete trench drain channel such that said frames are located at said upper opening of the inner profile of said concrete trench drain channel in said internal profile mould;

actuating the slipform paving machine to continuously slipform the concrete trench drain channel in concrete in between said exterior and interior moulds and around said frames; and repeating the above steps to form the entire concrete trench drain channel, such that the frames are at least partially embedded in said concrete and located across said opening.

2. The method of claim 1, wherein said frames are provided in lengths of between 1.5 metres and 2.5 metres long and are connected to one another by an adjustable fastener such as a turnbuckle.

3. The method of claim 1, wherein the ends of the frame are provided with one or more levelling lugs located at the abutting ends of said frames that contact the underside of the abutting frame to assist in levelling of said frames during slipforming.

4. The method of claim 1, wherein said frames have one or more protuberances that extend from said frame and are adapted to embed into said concrete and thereby anchor said frame in place after the concrete has cured.

5. The method of claim 4, wherein said protuberances include a reinforcing bar attached to, and running parallel to, at least one side of said frame, that is adapted to embed in said concrete and thereby anchor said frame in place after the concrete has cured.

6. A frame for a concrete trench drain channel, said frame defining an upper opening of said concrete trench drain channel and adapted to receive a grate, wherein said frame is adapted for the continuous concrete slipforming of said concrete trench drain channel; and wherein said frames have one or more protuberances extending from said frame and adapted to embed into said concrete and thereby anchor said frame in place after the concrete has cured; and wherein said protuberances include one or more parallel outrigger bars extending from at least one side of said frame, said one or more outrigger bars being adapted to embed in the concrete and anchor said frame in place after the concrete has cured.

* * * * *